US006874650B2

(12) United States Patent
Welsh et al.

(10) Patent No.: US 6,874,650 B2
(45) Date of Patent: Apr. 5, 2005

(54) STORAGE CONTAINER

(75) Inventors: Thomas Welsh, Aurora, IL (US); Michael C. Thuma, LaGrange, IL (US); Laura Morris, Willow Springs, IL (US)

(73) Assignee: Home Products International, Inc., Chicago, IL (US)

( * ) Notice: Subject to any disclaimer, the term of this patent is extended or adjusted under 35 U.S.C. 154(b) by 129 days.

(21) Appl. No.: 10/322,020

(22) Filed: Dec. 19, 2002

(65) Prior Publication Data

US 2004/0118737 A1 Jun. 24, 2004

(51) Int. Cl.[7] ..... B65D 1/24
(52) U.S. Cl. ..... 220/519; 220/508; 220/520
(58) Field of Search ..... 206/508, 519, 206/520, 518, 505, 507; 220/781, 784, 380, 788

(56) References Cited

U.S. PATENT DOCUMENTS

| | | | | | |
|---|---|---|---|---|---|
| 2,704,974 | A | * | 3/1955 | Steman | 99/422 |
| 3,442,420 | A | | 5/1969 | Edwards | |
| 3,480,178 | A | * | 11/1969 | Morgan | 206/506 |
| 3,701,456 | A | * | 10/1972 | Alroy et al. | 206/520 |
| 3,739,939 | A | | 6/1973 | Koenig | |
| 3,784,052 | A | | 1/1974 | Edwards | |
| 4,076,123 | A | * | 2/1978 | Davis | 206/503 |
| 4,660,716 | A | * | 4/1987 | McMahon et al. | 206/216 |
| 4,762,248 | A | | 8/1988 | Uhlig | |
| 4,874,103 | A | * | 10/1989 | Quisenberry et al. | 220/254.3 |
| 5,002,197 | A | * | 3/1991 | Ponsi | 220/255 |
| 5,071,008 | A | | 12/1991 | Hradisky | |
| 5,123,564 | A | | 6/1992 | Hobson | |
| 5,163,587 | A | * | 11/1992 | Apps et al. | 222/105 |
| 5,190,156 | A | | 3/1993 | Conaway et al. | |
| 5,407,089 | A | | 4/1995 | Bird et al. | |
| 5,445,273 | A | | 8/1995 | Apps | |
| D370,345 | S | | 6/1996 | Wolff | |
| D378,734 | S | * | 4/1997 | Hardy et al. | D9/425 |
| D379,122 | S | | 5/1997 | Wolff | |
| 5,718,350 | A | | 2/1998 | Williams | |
| 5,769,229 | A | * | 6/1998 | Andress et al. | 206/505 |
| D398,151 | S | | 9/1998 | Ahern, Jr. | |
| 5,904,269 | A | | 5/1999 | Wolff | |
| 5,906,291 | A | | 5/1999 | Mann et al. | |
| 5,915,581 | A | * | 6/1999 | Pfirrmann et al. | 220/4.21 |
| 6,047,853 | A | | 4/2000 | Frankenberg | |
| 6,149,006 | A | * | 11/2000 | Brauner et al. | 206/551 |
| 6,318,586 | B1 | | 11/2001 | Frankenberg | |

FOREIGN PATENT DOCUMENTS

| | | |
|---|---|---|
| DE | 19628934 | 1/1998 |
| EP | 0512179 | 11/1992 |
| GB | 1337569 | 11/1973 |
| GB | 1496889 | 1/1978 |
| SE | 301596 | 6/1968 |

* cited by examiner

*Primary Examiner*—Joseph C. Merek
(74) *Attorney, Agent, or Firm*—Wood, Phillips, Katz, Clark & Mortimer

(57) ABSTRACT

A stackable container, including side walls extending upwardly from a bottom wall and defining an open-top, enclosed space therein, and rigid support members spaced about the bottom wall, the rigid support members having a vertical height. The side walls are tapered outwardly so as to be stackable in a nesting relationship within a similar container with a stacking offset less than the support members vertical height whereby the support members are supported on aligned rigid support members of the similar container. Outwardly tapered stress-relieving triangular corner surfaces extend upwardly between 130° and 140° from corners of the bottom wall and connect to side walls to form each junction of the bottom wall with two side wall. A lid has a rim adapted for placement around a container rim, with inwardly projecting flanges on each of the lid rim sides whereby the flanges extend beneath a downwardly facing portion of the container rim adjacent each of the four walls to releasably secure the lid to the container rim.

11 Claims, 6 Drawing Sheets

14
70
86
86
72
80
86
76
78
10
12
42
40
36
30
22a
28a
28
60
50
20
54
60
60
50
22
50
60
54
60

STORAGE CONTAINER

FIELD OF THE INVENTION

This invention relates to improvements in plastic storage containers or totes, and in particular to a storage container having improved structural integrity and nesting features.

BACKGROUND OF THE INVENTION

Plastic storage containers or totes have been known for many years and have found widespread usage to store articles of various sizes. Typically, such storage containers or totes range in capacity from about 10 gallons to about 50 gallons and are frequently used by consumers in garages and basements to store relatively large items.

These storage containers comprise a relatively deep storage base portion and a relatively flat lid portion, both of which are made from a plastic material. The lid portion cooperates with the base portion so that the lid portion may be snapped into a closing relationship with the base portion.

During shipment and storage, it is important to be able to nest the base portions and the lid portions to reduce the volume for shipment and retail display. It is also important to be able to easily separate the nested base portions and lid portions.

SUMMARY OF THE INVENTION

In one aspect of the present invention, a stackable, nestable storage container for storing relatively large objects is provided, including a storage base member having an open top, and a lid member for closing the open top. The storage base member includes a bottom wall and a pair of opposing side walls and a pair of opposing end walls extending upwardly therefrom, with the bottom wall being formed with a channel extending outwardly therefrom adjacent the outer periphery thereof. The channel has at least one stacking leg formed therein adjacent each of the side walls and end walls, each of the stacking legs having an interior surface that faces into the base member and an exterior surface that faces outwardly of the base member. The side walls and the end walls extend upwardly and outwardly from the bottom portion so that when a plurality of the base members are nested inside one another, the exterior surfaces of the stacking legs of the open top portion rest upon corresponding interior surfaces of the stacking ribs of an immediately adjacent base member so as to concentrate downward forces through the stacking legs.

In one form of this aspect of the invention, each of the interior surfaces of the stacking legs have a recessed portion for receipt of an exterior surface of an aligned stacking leg of an immediately adjacent base member. Further, the stacking legs may include a plurality of flange portions that decrease in width as they extend towards the exterior surface, and the flange portions may be received in a generally cylindrical recessed portion.

In another form, the lid member is a central top portion and a downwardly extending skirt portion extends from the periphery of the top portion, with the skirt portion extending outwardly as it extends from the top portion to facilitate nesting of a plurality of lid members.

In another aspect of the present invention, a stackable container is provided, including side walls extending upwardly from a bottom wall and defining an open-top, enclosed space therein, and rigid support members spaced about the bottom wall, the rigid support members having a vertical height H. The side walls are tapered outwardly so as to be stackable in a nesting relationship within a similar container with a stacking offset less than H whereby the rigid support members are supported on aligned rigid support members of the similar container.

In one form of this aspect of the invention, an inwardly extending indentation is provided in at least one of the side walls, and downwardly open vent openings are provided through the one side wall at the upper end of the indentation.

In still another aspect of the present invention, a stack of open-top containers is provided, including a plurality of containers nested one in another, where each container has a bottom wall, tapered side walls extending upwardly from the bottom wall, the tapered side walls permitting nesting of one container within another with a stacking offset of H, and a plurality of rigid vertical support members spaced about the bottom wall. The rigid support members of each one of the containers nested in another of the containers rest on aligned rigid support members of the another of the containers to support the one of the containers in a stacking offset greater than H.

In one form of this aspect of the invention, the rigid support members have a vertical dimension greater than H.

In still another aspect of the present invention, a container is provided including four side walls connected along opposite edges in a generally rectangular configuration and extending upwardly from a generally rectangular bottom wall, and an outwardly tapered stress-relieving corner surface extending upwardly between 130° and 140° from the bottom wall and connecting to each two of the side walls to form each junction of the each two of the side walls and the bottom wall.

In a form of this aspect of the invention, the corner surface is generally triangularly shaped.

In yet another aspect of the present invention, a closable container is provided, including four side walls connected along opposite edges in a generally rectangular configuration and extending upwardly from a generally rectangular bottom wall, and a generally rectangular peripheral rim extending outwardly from the upper end of the four walls and including a downwardly facing lip adjacent each of the four walls. A generally rectangular removable lid includes a flexible downwardly extending rim on four sides and adapted for placement around the peripheral rim, and the downwardly extending rim includes an inwardly projecting flange on each of the sides whereby the inwardly projecting flanges on each of the sides extend beneath the downwardly facing lip adjacent each of the four walls to releasably secure the lid to the rim.

DETAILED DESCRIPTION OF THE PREFERRED EMBODIMENT

Figure 1:
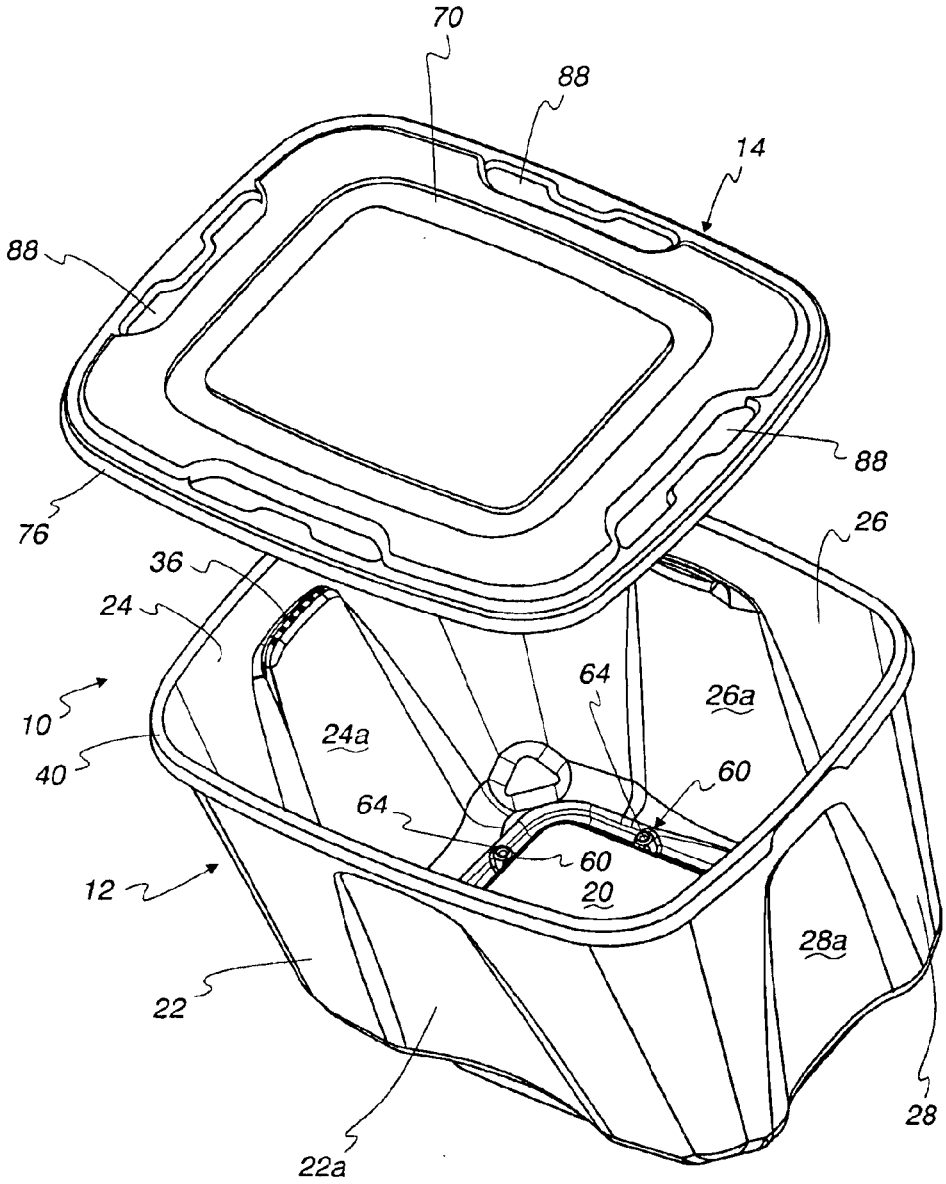
FIG. 1 is a perspective view of a storage container incorporating the invention, with the lid portion in a removed portion.
Figure 2:
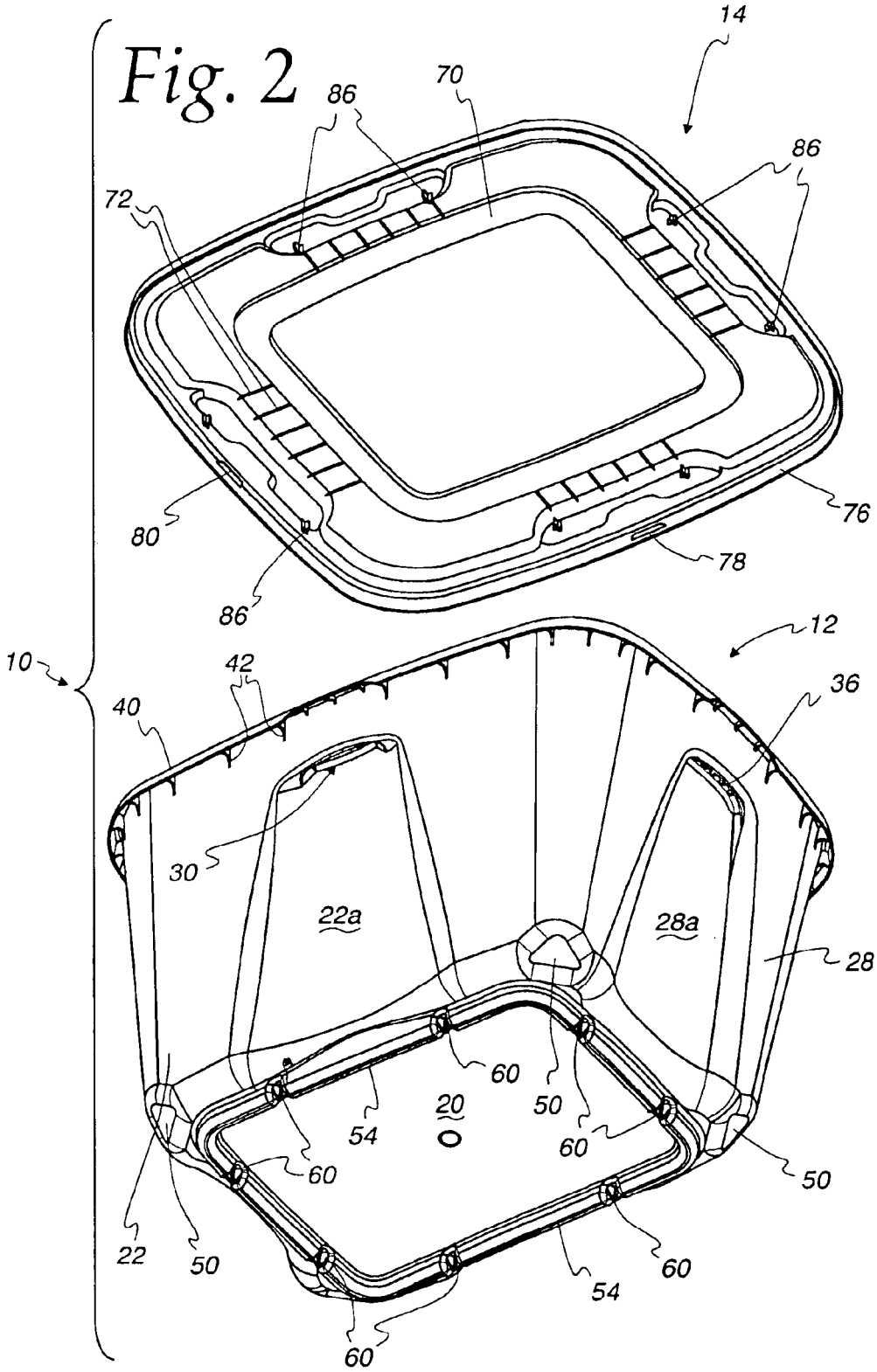
FIG. 2 is an additional perspective view of the storage container of FIG. 1.

A storage container 10 incorporating the present invention is disclosed in FIGS. 1–2. The container 10 includes a container base portion 12 and a removable lid 14.

The container base portion 12 includes a bottom wall 20 with four walls 22, 24, 26, 28 extending upwardly and suitably tapered outwardly therefrom. All four walls 22–28 may be characterized as side walls, or two walls (e.g., 22, 26) may be characterized as side walls with the other two walls (e.g., 24, 28) characterized as end walls. The taper of the walls 22–28 is such that the container base portion 12 may be relatively closely nested within another similarly shaped container base portion such as is known in the art to allow multiple container base portions to be compactly stored for shipping or for point of sale display.

Figure 4:
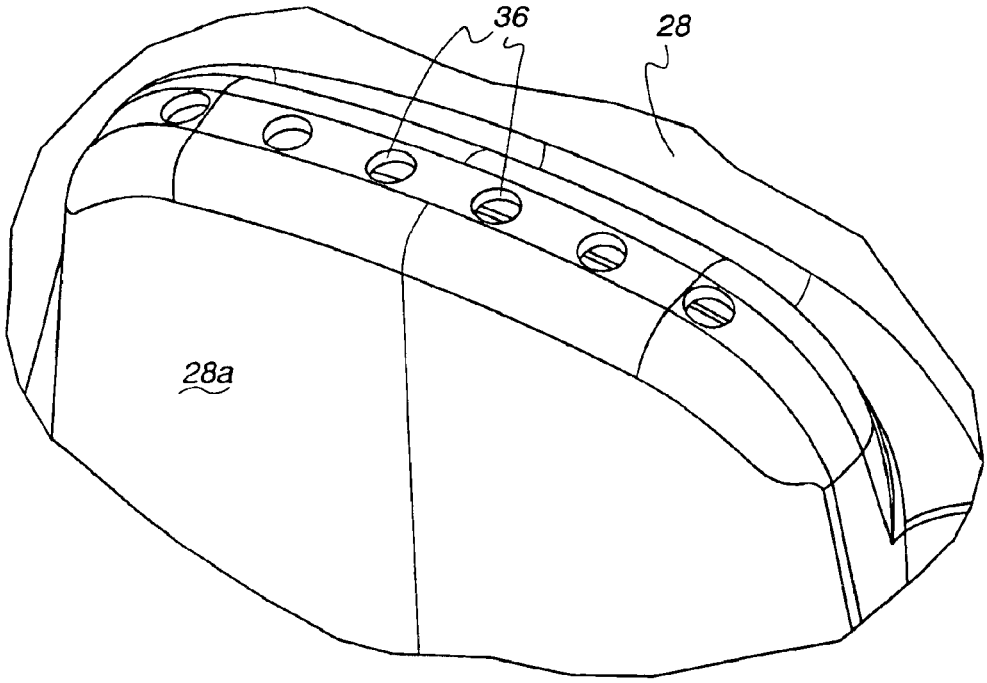
FIG. 4 is an enlarged perspective view of a handle section at the base portion as viewed from inside the container.

The walls 22–28 may be non-planar such as illustrated in order to provide additional stiffness to the walls 22–28, and further to allow other features as desired. For example, the upper end of the indentations 22*a*, 26*a* on walls 22, 26 may include recesses 30 (see FIG. 2) formed as handle grips to enable a person to easily pick up the container 10. As another example, the upper end of the indentations 24*a*, 28*a* on walls 24, 28 may be formed with vent openings 36 (see particularly FIG. 4), providing ventilation while still protecting the container 10 against rainfall if kept outside in the weather. Whatever variations from tapered planar walls may be used, it should be understood that the variations should preferably be themselves tapered, as is generally known in the art, in order to allow multiple containers to be closely nested together for shipping and storage and the like as previously described.

A stiffening rim 40 is provided around the upper end of the walls 22–28, with reinforcing ribs 42 provided beneath the rim 40 (see FIG. 2) to help to maintain the generally rectangular opening at the top of the container base portion 12.

In accordance with one aspect of the present invention, the bottom corners of the container base portion 12 are shaped to include an outwardly tapered stress-relieving corner surface 50 extending upwardly between 130° and 140° from the bottom wall 20 and connecting to adjacent walls (e.g., wall 22 and wall 28 in FIG. 2) to form each junction of three walls. As best seen in FIG. 2, the corner surfaces are generally triangular in shape. Such corner surfaces 50 not only assist in relieving stress (and thereby helps to prevent undesirable cracking) but also assist in preventing stacked containers 10 from becoming stuck in one another.

The bottom wall 20 may include a recessed channel 54 generally around the bottom wall outer periphery and, in accordance with one feature of the present invention, rigid support legs 60 may be spaced around the channel 54.

Figure 3:
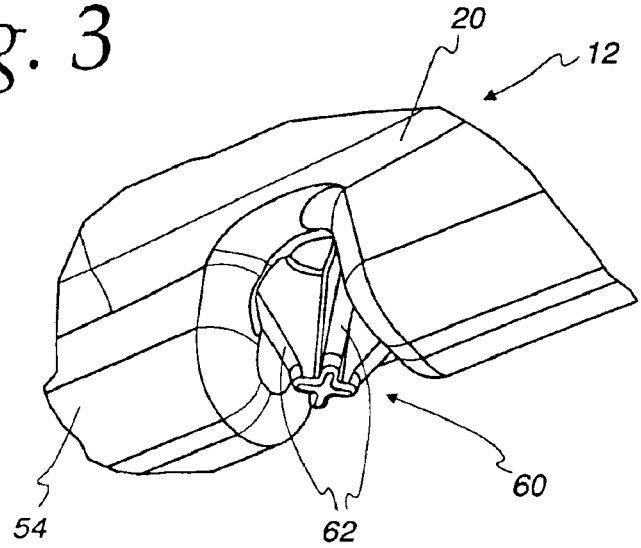
FIG. 3 is an enlarged perspective view of a leg section associated with the base portion.

As best seen in FIG. 3, the support legs 60 may comprise a rigid structure which is tapered down toward a smaller lower end. For example, as illustrated the support legs 60 may include flange portions 62 arranged in an "X" configuration and decreasing in width toward the bottom of the leg 60. The upper end of the legs 60 may include a depression 64 (see FIG. 1) adapted to receive the lower end of the support legs in a similar container base portion stacked therein as further described hereafter.

Figure 5:
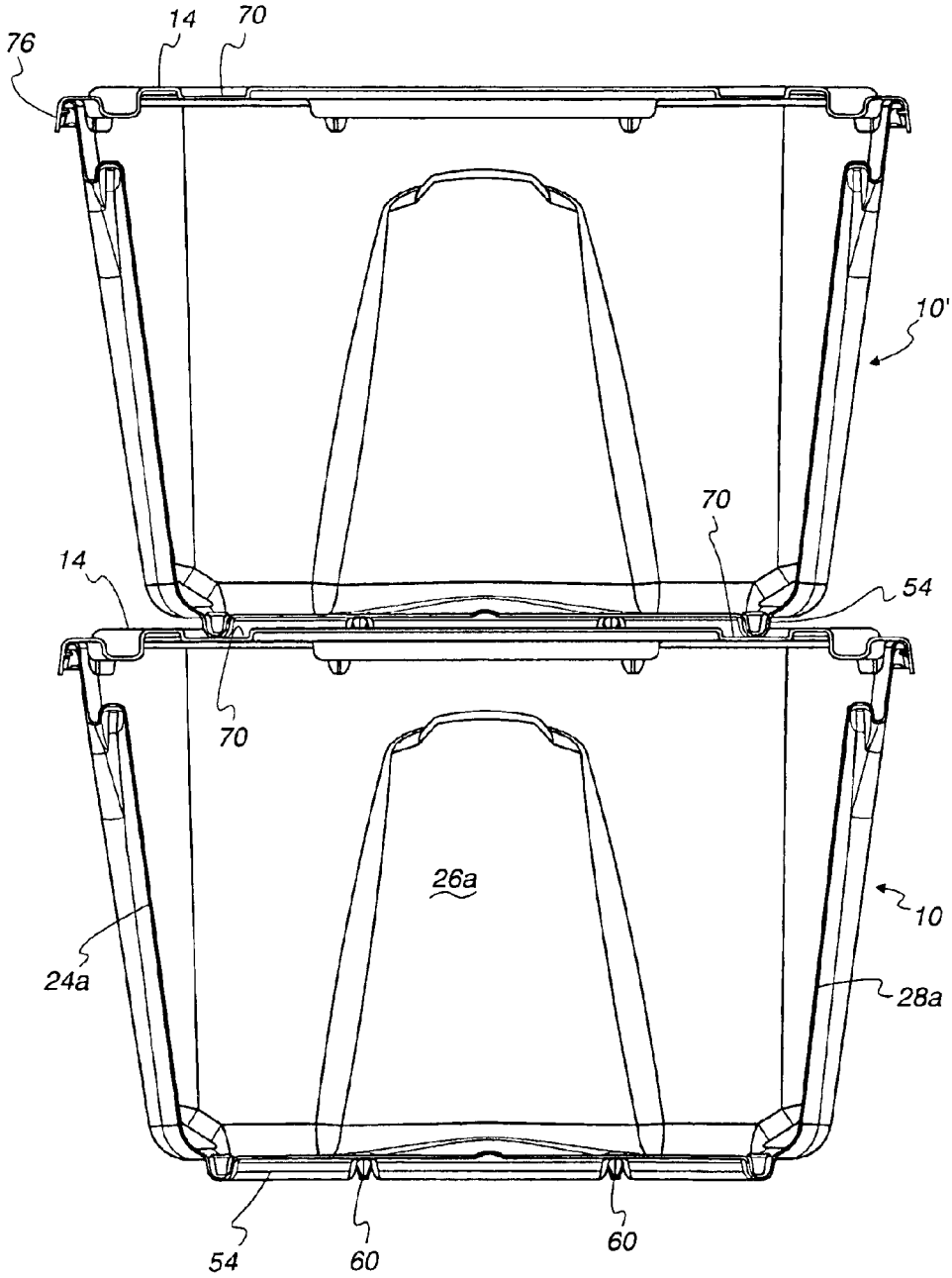
FIG. 5 is a side elevational cross-sectional view showing the stacking of two storage containers of FIG. 1.

The removable lid 14 of the container 10 may include a recess 70 in its upper surface, which recess 70 not only assists in reinforcing the lid 14 (together with reinforcing ribs 72 shown in FIG. 2), but also may serve as a guide and retainer for a second container 10' stacked thereon, by receiving the bottom portion of the recessed channel 54 in the bottom wall 20 of such container 10', as illustrated in FIG. 5. Multiple containers 10, 10' may therefore be filled and reliably stacked without risk of one sliding off the other, since the channel 54 received in the recess 70 not only prevents such sliding, but also ensures that the containers will be properly centered over one another is a secure, safe vertical stack.

Figure 6:
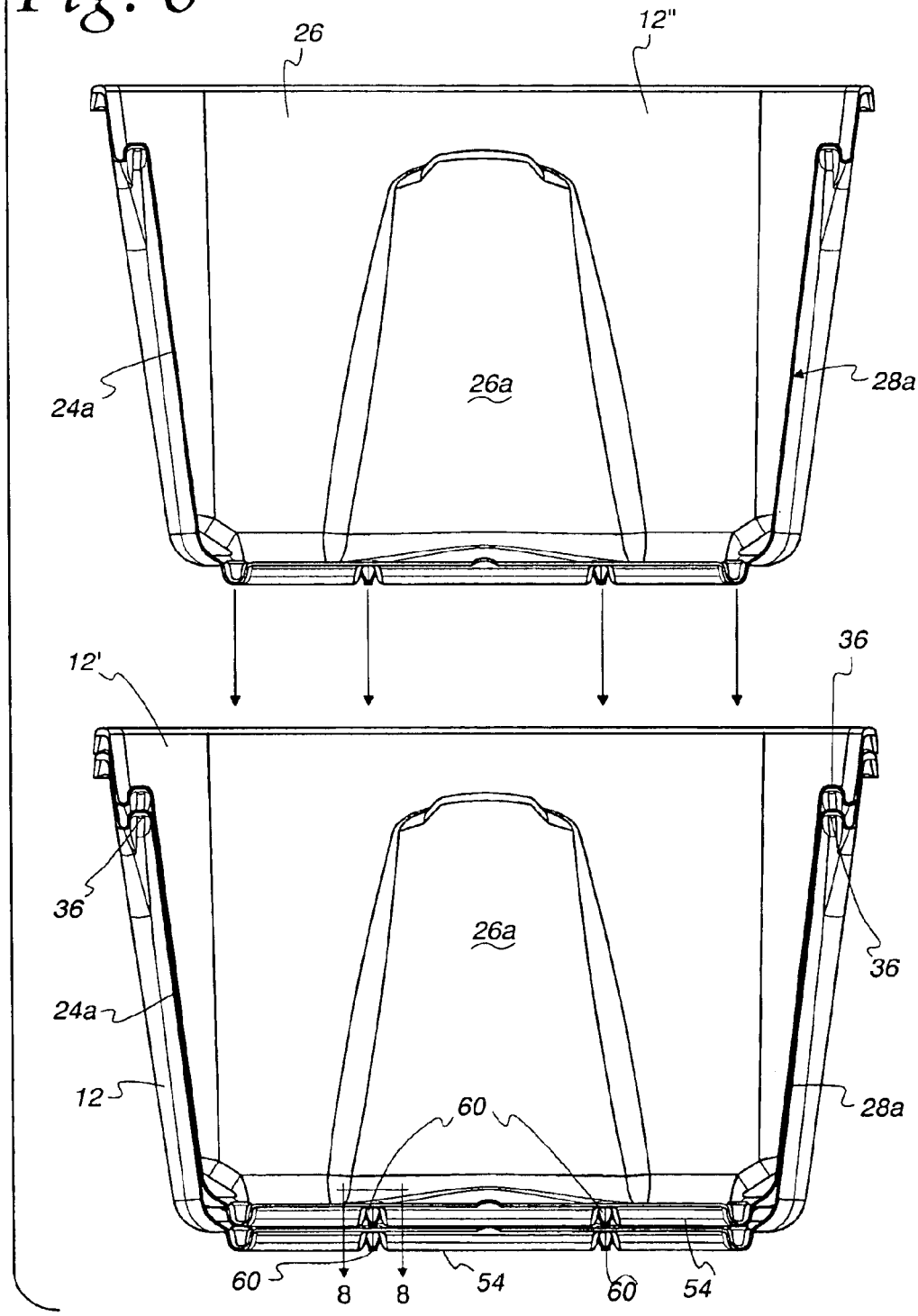
FIG. 6 is a side elevational cross-sectional view showing the nesting of two storage containers of FIG. 1.
Figure 8:
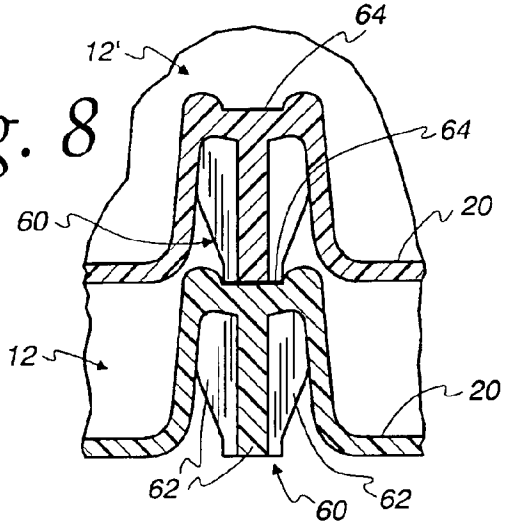
FIG. 8 is an exploded view of portion 8—8 in FIG. 6.

FIG. 6 illustrates two container base portions 12, 12' nested together in a shipping and/or storage position with a third container base portion 12" positioned above and being lowered into a nesting position as well. As illustrated with the nested container base portions 12, 12', the rigid support legs 60 of the top base portion 12' are supported in the depressions 64 in the top of the support legs of the bottom base portion 12 (see particularly the detailed cross-section of FIG. 8). Further, since the support legs 60 extend to the bottom of the container base portions 12, 12', 12", the support legs of the bottom-most base portion 12 will engage the ground on their lower end.

The walls 22–28 of the container base portions 12 are tapered to provide a stacking offset of H, where the stacking offset is the vertical spacing of corresponding surfaces of nested container base portions if the base portions were to be stacked without any interference from the support legs 60 (i.e., nesting with tapered surfaces frictionally contacting to prevent closer nesting). In accordance with at least one aspect of the present invention, the support legs have a vertical height (i.e., height between the bottom of the leg 60 and the depression on top 64) of at least H. In such a case, it should be appreciated that stacked container base portions 12 will be substantially supported by the stacks of support legs 60, with each stack of aligned legs 60 essentially forming support columns from which the weight of the stacked base portions 12 is substantially supported.

With such a structure, it should be appreciated that the container base portions 12 will not plastically stretch the container below it as it is forced therein under the weight of more and more base portions stacked thereon. Such stretching can result in binding of stacked base portions, with the stretched outer walls of a bottom base portion gripping the walls of a base portion nested therein like a strong rubber band. Avoiding this tight contact between the nested container walls will therefore substantially reduce the problem of the stacked base portions being stuck together. It should also be appreciated that the vent openings 36 will also assist in this regard by allowing air to vent into space between the nested container base portions 12 (as seen in the upper left and right sides of the nested base portions 12, 12' shown in FIG. 6). Therefore, the container base portions 12 may be easily separated even after stacked in nesting positions for long periods of time. This not only prevents damage to the base portions which could occur if rough handling were required to pull one from another, but it also prevents potential lost sales which can occur when a customer wishes to purchase the container but chooses not to when he is unable to pull one from the stack in the point of sale display. Further, preventing distortion of stacked base portions ensures that plastic base portions will not creep to a larger size over time, thereby preventing potentially weakening of the walls and also preventing potentially causing the lid 14 to not fit as easily thereon as designed and as originally manufactured.

The removable lid 14 includes a downwardly extending rim or skirt 76 around its outer periphery which is sized to generally fit over and around the stiffening rim 40 of the container base portion 12. Extending inwardly at central locations on all four sides of the rim 76 may be snap-locking flanges 78, 80 (one of each can be seen in FIG. 2), which will snap into place beneath downwardly facing surfaces of the container base portion rim 40 to releasably hold the lid 14 in place on top of the container base portion 12. The flanges 78 on the sides corresponding to the walls 22, 26 may extend inwardly to a lesser degree than the flanges 80 on the other walls 24, 26, whereby the flanges 80 will provide the primary securing means, with the flanges 78 providing a secondary assisting securement of the lid 14 to the base portion 12.

Figure 7:
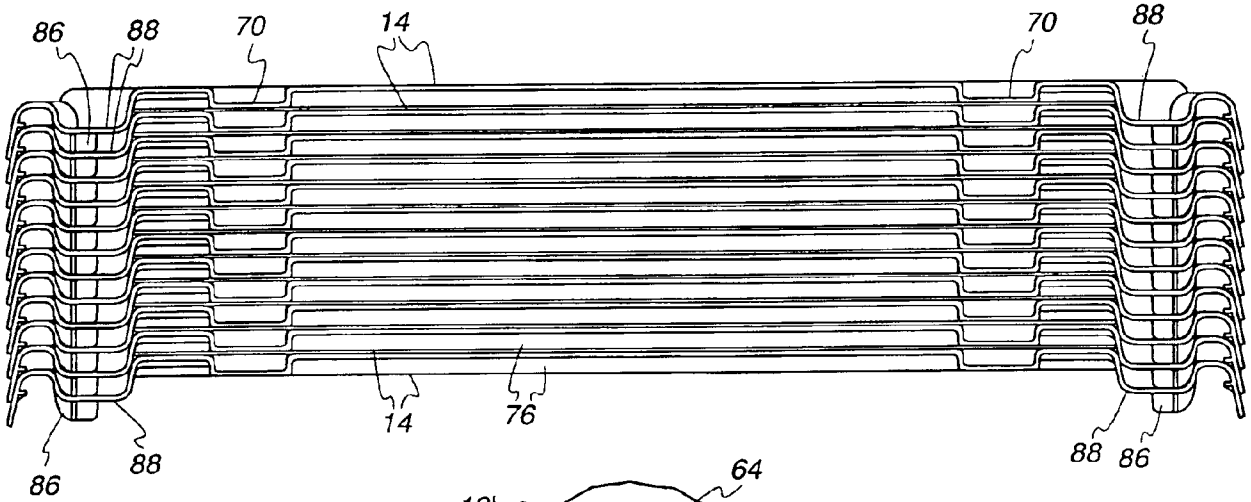
FIG. 7 is a side elevational cross-sectional view showing the nesting of a plurality of lid portions.

The lid 14 may also have support legs 86 spaced around its bottom side (see FIG. 2), which legs 86 may provide a similar support function to permit stacking of lids for shipping and storage with the container base portions 12. For aesthetic reasons, the lid support legs 86 may not be visible from the top of the lid 14 (i.e., need not have depressions 64 such as described with the with the body portion legs 60). Instead, as illustrated in FIG. 7, the legs 86 may extend from beneath larger, aesthetically pleasing depressions 88 in the lid 14, with the legs 86 received in such depressions 88 of a lid 14 stacked therebeneath. Further, as shown in FIG. 7, the outwardly facing flange of the legs 86 may be curved to match the side wall of the lid depression 88 on all four sides of the lid 14 so that stacked lids 14 are readily maintained in an aligned position on top of each other with the legs 86 themselves aligned to provide a supporting column such as already described with the container body portion 12.

It should therefore be appreciated that containers 10 embodying all aspects of the present invention such as described above may be advantageously stacked together for shipping and storage. Such containers 10 with stress reducing corners may also be less susceptible to damage. Still further, the such containers 10 have lids 14 which may be reliable releasably secured to the container body portion 12.

What is claimed is:

1. A stackable, nestable storage container for storing relatively large objects, comprising:

a storage base member having an open top, including a bottom wall and a pair of opposing side walls and a pair of opposing end walls extending upwardly therefrom, said bottom wall being formed with a channel extending outwardly therefrom adjacent the outer periphery thereof;

a lid member for closing said open top;

said channel having a plurality of spaced stacking legs formed therein adjacent to and spaced from each of said side walls and end walls, each of said stacking legs having an interior surface that faces into said base member and an exterior surface that faces outwardly of said base member;

said side walls and said end walls extend upwardly and outwardly from said bottom portion so that when a plurality of said base members are nested inside one another, the exterior surfaces of the stacking legs of the open top portion rest upon corresponding interior surfaces of the stacking legs of an immediately adjacent base member so as to concentrate downward forces through said stacking legs;

wherein when said base members are nested inside one another, said base members are supported on an underlying surface substantially through vertically aligned stacks of said stacking legs.

2. The storage container as defined in claim 1 wherein each of said interior surfaces of said stacking legs have a recessed portion for receipt of an exterior surface of an aligned stacking leg of an immediately adjacent base member.

3. A stackable, nestable storage container for storing relatively large objects, comprising:

a storage base member having an open top, including a bottom wall and a pair of opposing side walls and a pair of opposing end walls extending upwardly therefrom, said bottom wall being formed with a channel extending outwardly therefrom adjacent the outer periphery thereof;

a lid member for closing said open top;

said channel having at least one stacking leg formed therein adjacent each of said side walls and end walls, each of said stacking legs having an interior surface that faces into said base member and an exterior surface that faces outwardly of said base member;

said side walls and said end walls extend upwardly and outwardly from said bottom portion so that when a plurality of said base members are nested inside one another, the exterior surfaces of the stacking legs of the open top portion rest upon corresponding interior surfaces of the stacking legs of an immediately adjacent base member so as to concentrate downward forces through said stacking legs;

wherein each of said interior surfaces of said stacking legs have a recessed portion for receipt of an exterior surface of an aligned stacking leg of an immediately adjacent base member and said stacking legs include a plurality of flange portions that decrease in width as they extend towards said exterior surface.

4. The storage container as defined in claim 3 wherein said flange portions are received in a generally cylindrical recessed portion.

5. The storage container as defined in claim 1 wherein said lid member comprises a central top portion and a downwardly extending skirt portion extending from the periphery of said top portion, said skirt portion extends outwardly as it extends from said top portion to facilitate nesting of a plurality of lid members.

6. The storage container as defined in claim 1, further comprising:

a peripheral rim extending outwardly from the upper ends of said opposing side walls and said opposing end walls, said rim including downwardly facing lips adjacent both of either said side walls or said end walls;

a flexible downwardly extending rim on said lid member and adapted for placement around said peripheral rim, said downwardly extending rim including inwardly projecting flanges adapted to extend beneath said downwardly facing lips to releasably secure said lid to said peripheral rim.

7. The storage container as defined in claim 1, wherein:

said side walls define an open-top, enclosed space therein;

said stacking leg comprises a plurality of stacking legs spaced about said bottom wall and having a vertical height H;

wherein said side walls are tapered outwardly so as to be stackable in a nesting relationship within a similar container with a stacking offset less than H whereby said stacking legs are supported on aligned stacking legs of said similar container.

8. The stackable container of claim 7, further comprising an inwardly extending indentation in at least one of said side walls, and downwardly open vent openings through said one side wall at the upper end of said indentation.

9. The storage container of claim 1, wherein:

said four side walls are connected along opposite edges in a generally rectangular configuration and extend upwardly from a generally rectangular bottom wall; and further comprising an outwardly tapered stress-relieving corner surface extending upwardly between 130° and 140° from said bottom wall and connecting to each two of said side walls to form each junction of said each two of said side walls and said bottom wall.

10. The container of claim 9, wherein said corner surface is generally triangularly shaped.

11. The storage container of claim 1, wherein:

said four side walls are connected along opposite edges in a generally rectangular configuration and extend upwardly from a generally rectangular bottom wall; and further comprising a generally rectangular peripheral rim extending outwardly from said upper end of said four walls and including a downwardly facing lip adjacent each of said four walls; and a generally rectangular removable lid including a flexible downwardly extending rim on four sides and adapted for placement around said peripheral rim, said downwardly extending rim including an inwardly projecting flange on each of said sides whereby said inwardly projecting flanges on each of said sides extend beneath said downwardly facing lip adjacent each of said four walls to releasably secure said lid to said peripheral rim.

* * * * *